US005163868A

United States Patent [19]

Adams et al.

[11] Patent Number: 5,163,868

[45] Date of Patent: Nov. 17, 1992

[54] POWERED RAIL COIN SORTER

[76] Inventors: Thomas P. Adams, 7524 Thomas Dr., Oconomowoc, Wis. 53066; John H. Winkelman, W253 S. 4340 Meadowview Dr., Waukesha, Wis. 53186

[21] Appl. No.: 714,411

[22] Filed: Jun. 12, 1991

[51] Int. Cl.[5] ..... G07D 3/04

[52] U.S. Cl. ..... 453/11; 453/56

[58] Field of Search ..... 453/7, 9, 11, 56; 194/334; 198/690.2, 699.1

[56] References Cited

U.S. PATENT DOCUMENTS

| | | | |
|---|---|---|---|
| 454,653 | 6/1891 | Kirkmeyer . | |
| 641,496 | 1/1900 | Busch . | |
| 1,038,293 | 9/1912 | Chiger . | |
| 2,101,513 | 2/1936 | Samuelsen et al. . | |
| 3,079,934 | 3/1963 | Thompson | 453/9 |
| 3,396,737 | 5/1966 | Picollo . | |
| 3,621,854 | 11/1969 | Redman . | |
| 3,939,954 | 2/1976 | Collins | 194/334 X |
| 4,072,156 | 2/1978 | Abe . | |
| 4,178,502 | 2/1979 | Zimmerman . | |
| 4,261,377 | 4/1981 | Ueda . | |
| 4,271,855 | 6/1981 | Ueda . | |
| 4,535,794 | 8/1985 | Bellis et al. | 453/56 |
| 4,657,035 | 4/1987 | Zimmerman . | |
| 4,681,204 | 7/1987 | Zimmerman . | |
| 5,059,153 | 10/1991 | Goi | 453/11 |

FOREIGN PATENT DOCUMENTS

| | | | |
|---|---|---|---|
| 0235670 | 9/1960 | Australia | 198/690.2 |
| 0011062 | 7/1908 | Denmark | 453/9 |
| 632388 | 7/1936 | Fed. Rep. of Germany | 453/11 |
| 920477 | 11/1954 | Fed. Rep. of Germany | 198/699.1 |
| 1909087 | 8/1970 | Fed. Rep. of Germany | 453/11 |
| 2311529 | 9/1973 | Fed. Rep. of Germany . | |
| 2623974 | 12/1977 | Fed. Rep. of Germany . | |
| 2838746 | 3/1980 | Fed. Rep. of Germany | 453/11 |
| 0650935 | 2/1929 | France | 198/690.2 |
| 1311164 | 7/1964 | Japan . | |
| 3408470 | 11/1970 | Japan . | |
| 0157787 | 1/1933 | Switzerland | 453/9 |
| 1082768 | 9/1967 | United Kingdom | 198/690.2 |
| 2034677 | 6/1980 | United Kingdom | 453/9 |
| 2130779 | 6/1984 | United Kingdom | 453/9 |

OTHER PUBLICATIONS

Sparks "Rough-Top Conveyor Belts" brochure, Apr. 1986.

*Primary Examiner*—Michael S. Huppert
*Assistant Examiner*—William M. Hienz

[57] ABSTRACT

A sorter for mixed denominations of coins has an inclined feeding disc which carry coins on flights from a hopper to the entrance of an inclined track having a referenced edge comprises a rail with a lip on the rear of the rail. The surface of the inclined track is defined by a series of adjustable gates which define openings with the rail that are sized to the respective diameters of the coins to be sorted. Coins entering the track are engaged by an endless of belt or series of belts having projections, such as inclined fingers, that are spaced from the surface of the track a distance less then the thinnest coin. When the coins distort the projections upon entering the track, they are forced against the rail and are thereafter carried by the belt along the track until they reach their respective opening. At the opening, the release of the distorted projections imparts a force which lifts the coins over the lip and through the opening.

12 Claims, 7 Drawing Sheets

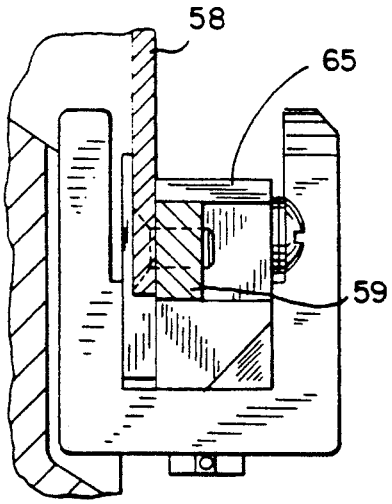
FIG. 6
FIG. 5
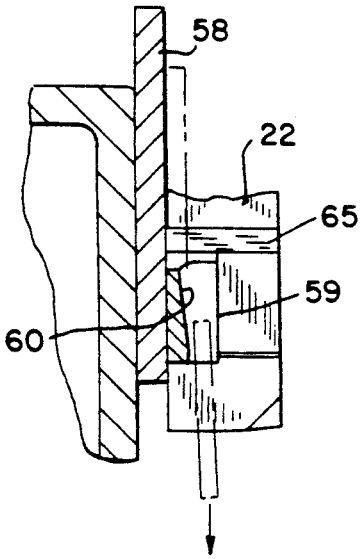
FIG. 7
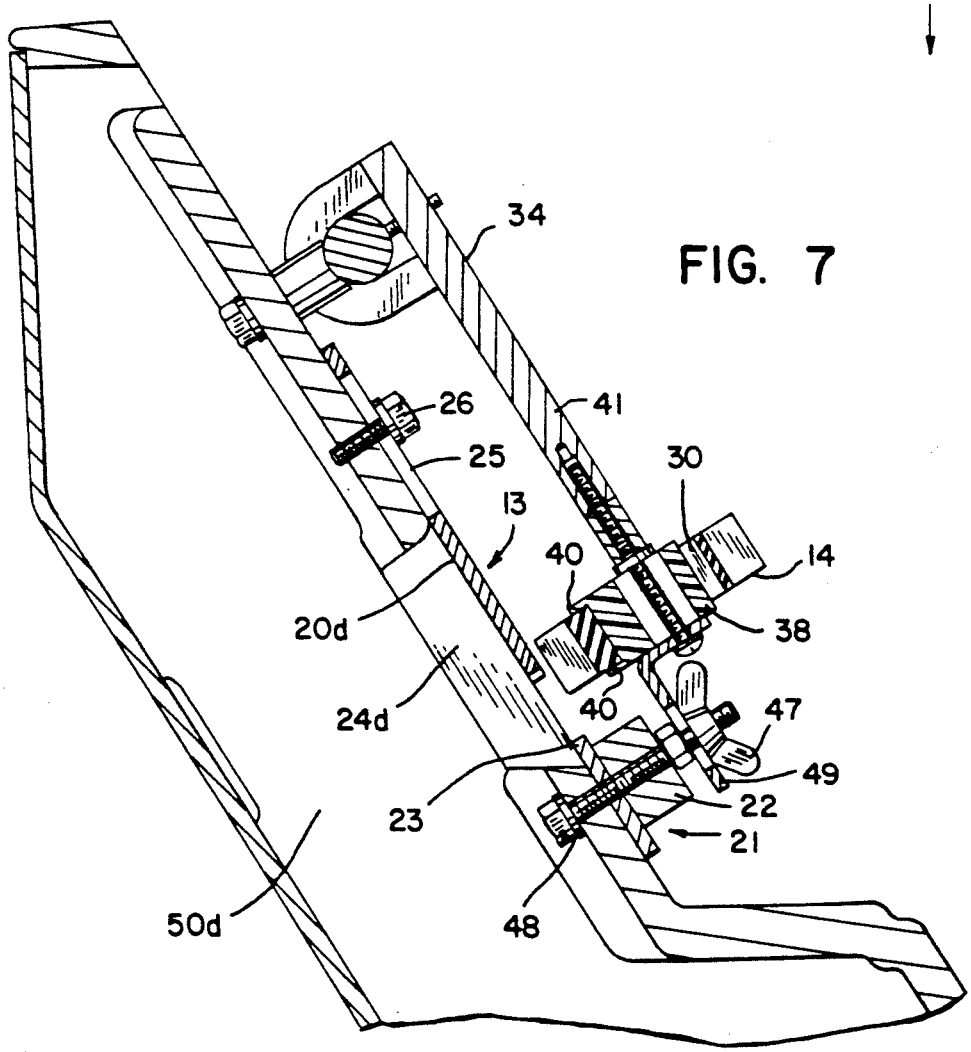

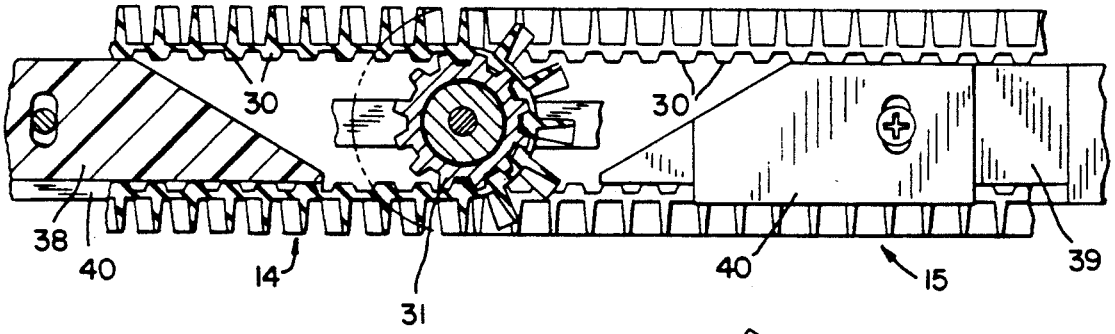
FIG. 8
FIG. 9
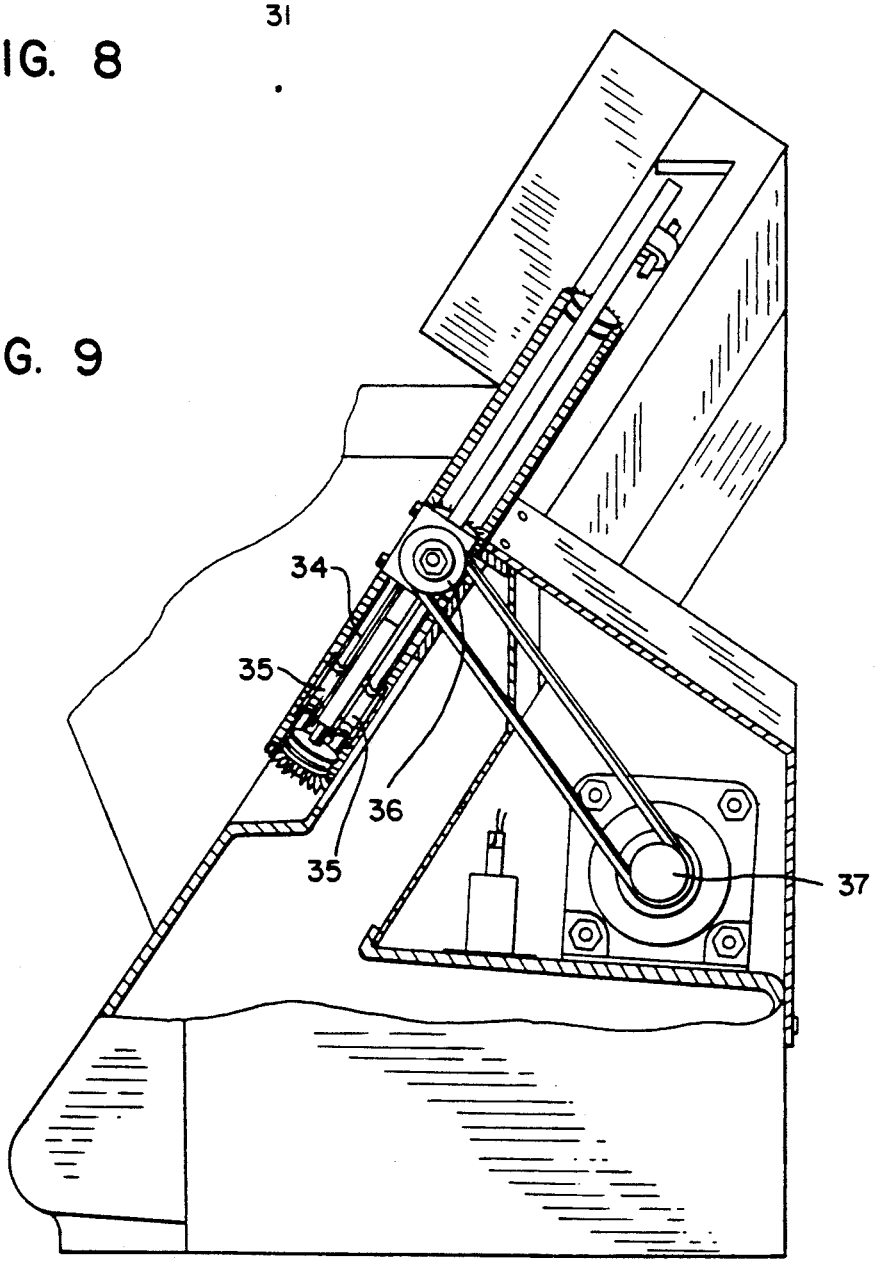

FIG. 16
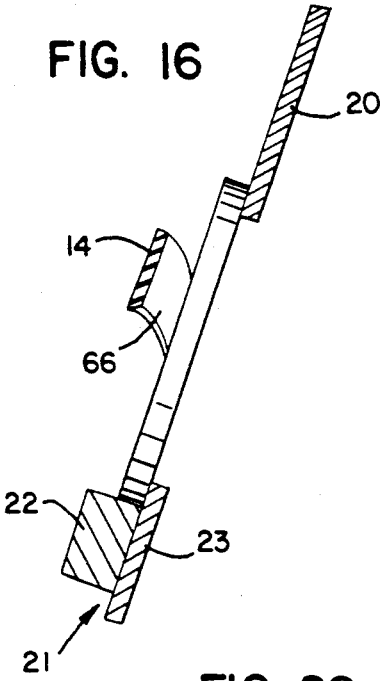
FIG. 17
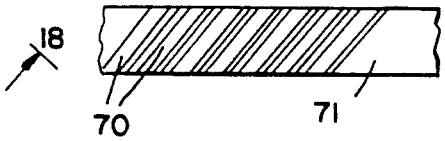
FIG. 18
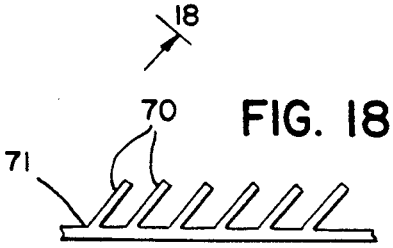
FIG. 19
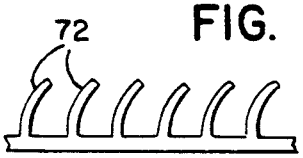
FIG. 20
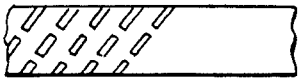
FIG. 21
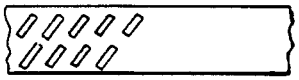
FIG. 22
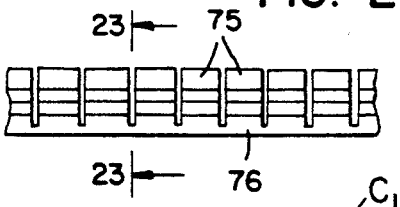
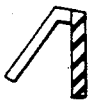
FIG. 25
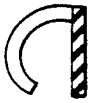
FIG. 26
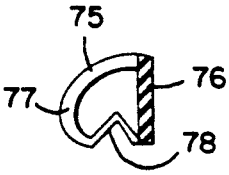
FIG. 23
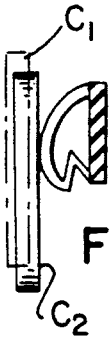
FIG. 24

POWERED RAIL COIN SORTER

BACKGROUND OF THE INVENTION

This invention relates to coin sorters, and particularly to a coin sorter in which a single layer and single file of coins of mixed denominations are moved along a track past openings that are each sized to accept a particular diameter of coin to be sorted.

A common form of coin sorter includes a mechanism that accepts a mass of coins of mixed denominations and feeds the coins in a single file and a single layer to the entrance to a track. The coins in the single file are moved along the track and past openings of increasing size. The openings are sized for each of the respective diameters of the coins in the mix. As the coins move past an opening, coins of the size of that opening will pass through the opening and drop into a chute that leads to a point of collection, which may be either a drawer or a bag. The coins are counted by sensors as they move along the track or as they move through the openings.

The coins can be moved along the track by the use of gravity, in which case the track is disposed in a plane inclined from the vertical and the track is inclined relative to the horizontal. An example of this simple form is shown in U.S. Pat. No. 454,653 issued Jun. 23, 1891 to Kirkmeyer. However, when a horizontal track is employed, the coins must be physically moved along the track and this is usually done by one or more driven endless belts. Examples of this form are shown in U.S. Pat. Nos. 4,072,156 issued Feb. 7, 1978 to Abe; 4,271,855 issued Jun. 9, 1981 to Ueda; and 4,657,035 issued Apr. 14, 1987 to Zimmermann. Driven endless belts have also been used in conjunction with inclined tracks as exemplified by U.S. Pat. No. 2,101,513 issued Dec. 7, 1937 to Samuelsen, et al.

It is important for the proper operation of track type sorters that the single file of coins be kept against a reference edge so that the coins are properly oriented relative to the openings. This is particularly important when coins to be sorted differ in diameter by only a slight amount. If a coin is not against the reference edge, it may fail to pass through the opening for its size and instead exit at an earlier or a later opening and therefore be mis-sorted. It is also important that a properly oriented coin will pass through its correct opening. The present invention is directed to an improved track sorter in which the belt is configured to insure that the coins will be positioned against the referenced edge and will be positively ejected at their correct opening. The sorter is particularly useful in handling coins whose periphery is non-circular.

SUMMARY OF THE INVENTION

In accordance with the invention, a coin sorter includes a track having a rail defining a reference edge and a plurality of openings in the track extending away from the rail with each opening sized to receive a coin of a particular diameter. A coin feeding mechanism receives coins of mixed denominations and provides a single file and a single layer of such coins to an entrance to the track. A powered endless belt extends along the track and is spaced therefrom to accept the coins in the single file between the belt and the track. The belt has a coin engaging surface defined by a plurality of flexible projections that when distorted by the coins force the coins against the reference edge while the belt moves the coins along the track. The distorted flexible projections also propel the coins through the openings when the appropriate opening is reached.

The projections can take the form of spaced rectangular fingers extending across the width of the belt and at an angle relative to the length of the belt. The fingers can be inclined from a plane normal to the surface of the belt or the fingers can be curved from a plane normal to the surface. Each finger can be defined by a plurality of segments arrayed across the width of the belt.

The projections on the belt can also be a series of spaced segments each rising from a common base for the belt and extending from one edge of the base across the width of the belt. Such segments can either be free of the opposite edge of the base or connected to the opposite edge of the base by a portion of reduced cross-section.

The coin sorter preferably uses a stationary and relatively inflexible guide plate behind the run of the belt that engages the coins. The rear of the belt can be provided with teeth that are engaged by a sprocket wheel for driving the belts. A pair of overlapping belts can be used instead of a single belt to cover a long distance of travel along the track. The sides of the openings opposite the rail are defined by a series of adjustable gates which preferably have an edge profile adapted to prevent jamming of coins in the corners of the openings.

It is a principal object of the invention to provide an improved track type coin sorter which can handle a wide variety of denominations and shapes of coins, including denominations that differ only slightly in their diameters.

It is another object of the invention to provide such a coin sorter that employes a powered belt to move the coins along the track and to maintain the coins against a reference edge of the track.

It is also an object of the invention to provide such a coin sorter in which the powered belt will propel the coins through their respective openings.

The foregoing and other objects and advantages of the invention will appear in the following detailed description. In the description reference is made to the accompanying drawings which show preferred embodiments of the invention.

BRIEF DESCRIPTION OF THE DRAWINGS

FIG. 5 is an enlarged view in vertical section taken in the plane of the line 5—5 of FIG. 3;

FIG. 6 is an enlarged view in vertical section taken in the plane of line 6—6 of FIG. 3;

FIG. 7 is a view in vertical section taken in the plane of the line 7—7 of FIG. 2;

FIG. 8 is a view in horizontal section taken in the plane of the line 8—8 of FIG. 2 and illustrating the overlapping belt structures;

FIG. 9 is a view in vertical section and partially in elevation taken in the plane of the line 9—9 of FIG. 2;

FIG. 16 is a partial view in vertical section illustrating the deformation of the fingers of the belt as the belt moves coins along the rail;

FIG. 17 is plan view of a length of a first alternate belt construction;

FIG. 18 is a side view of the belt of FIG. 17 viewed from the plane of the line 17—17;

FIG. 19 is a view similar to FIG. 18 but showing alternative curved fingers on the belt;

FIG. 20 is a plan view of a third alternative belt construction;

FIG. 21 is a plan view of a fourth alternative belt construction;

FIG. 22 is a side view in elevation of a fifth alternative belt construction;

FIG. 23 is a view in vertical section taken in the plane of the line 23—23 of FIG. 22;

FIG. 24 is a view similar to FIG. 23 but showing the belt distorted by a coin; and FIGS. 25 and 26 are views in vertical section through additional alternative belt constructions.

DETAILED DESCRIPTION OF THE PREFERRED EMBODIMENTS

Figure 1:
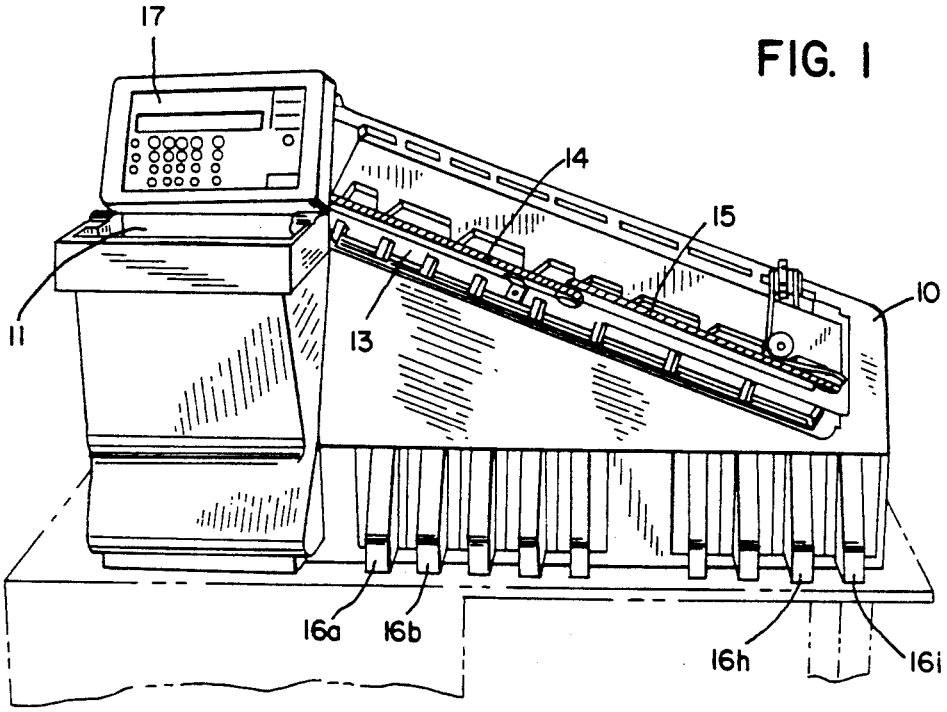
FIG. 1 is a view in perspective of a coin sorter incorporating the present invention.
Figure 3:
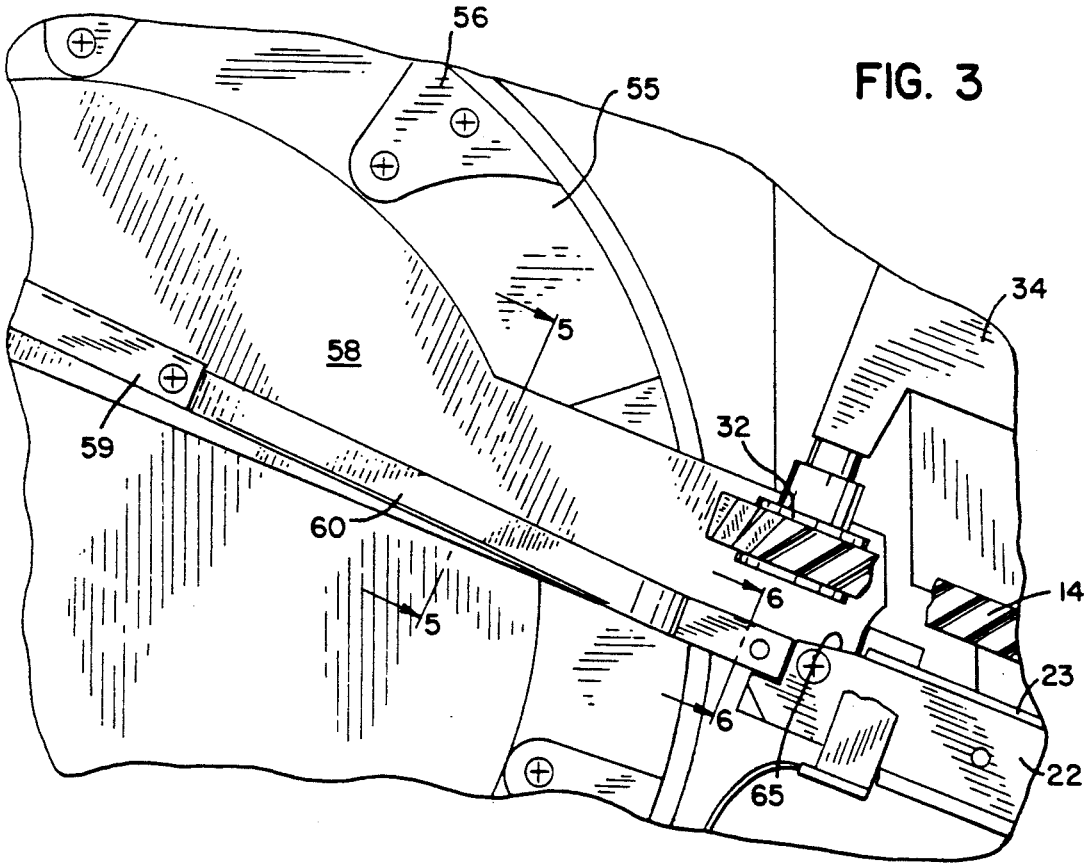
FIG. 3 is an enlarged partial elevation view of the transition between the coin feeding mechanism and the track.
Figure 2:
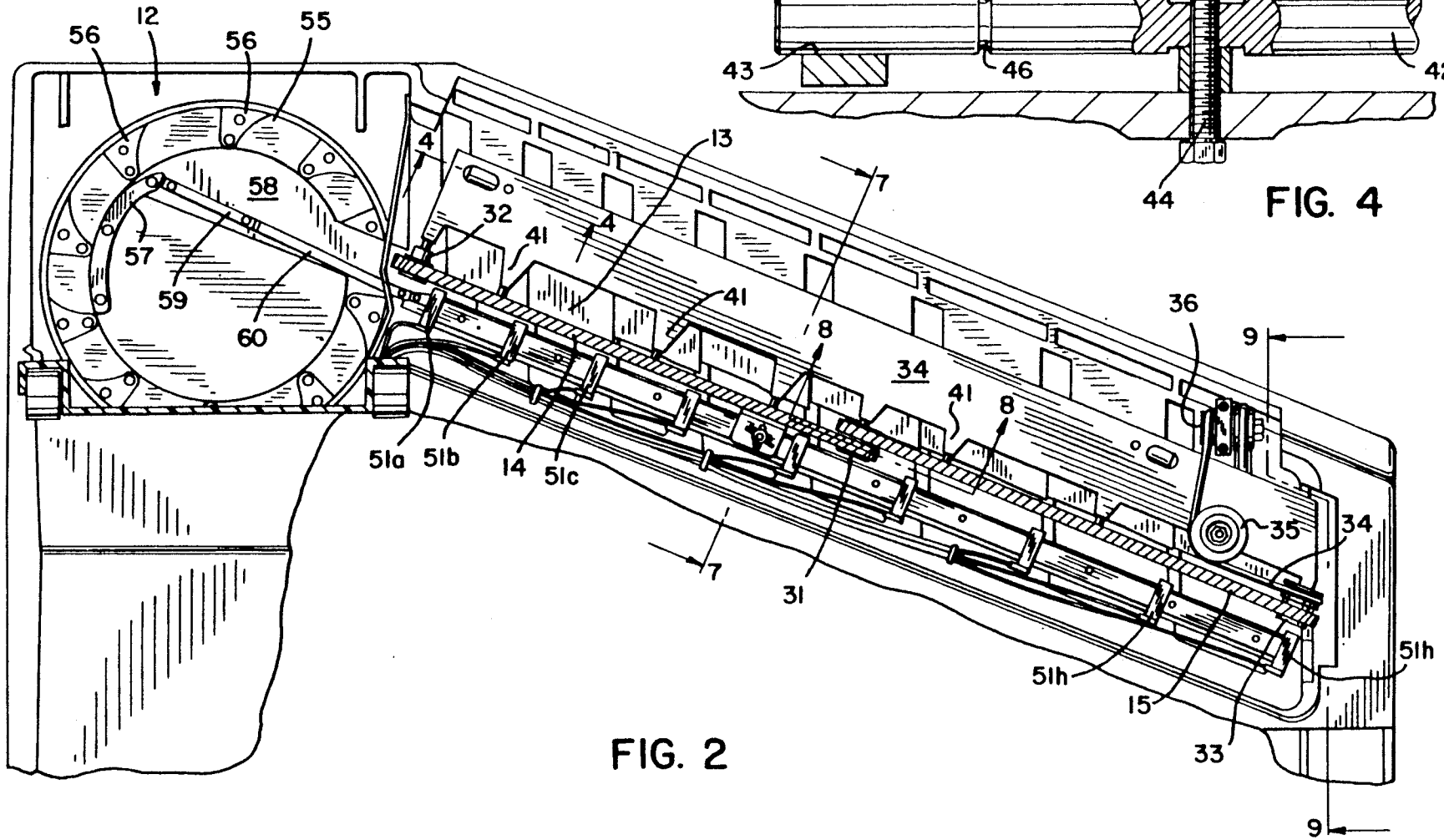
FIG. 2 is an enlarged view in elevation of the coin feeding mechanism and track of the coin sorter of FIG. 1.

Referring to FIGS. 1 and 2, a coin sorter incorporating the present invention has a molded housing 10 that includes a coin hopper 11 at one end. The hopper 11 leads to a coin feeding mechanism, indicated generally by the numeral 12, which moves coins from the hopper 11 to the entrance of an inclined track indicated generally by the numeral 13. The coins are moved along the track by a pair of overlapping continuous belts 14 and 15. As the coins are moved along the tracks they will pass through openings in the track, as will be described in detail, so that each denomination of coin is deposited through a respective opening, down a chute for that size coin, and into one of a series of removable drawers 16*a*–16*i* disposed in the housing 10 and beneath the inclined track 13. A control panel 17 is hinged to the housing 10 and normally covers the coin feeding mechanism 12, as shown in FIG. 1.

Figure 14:
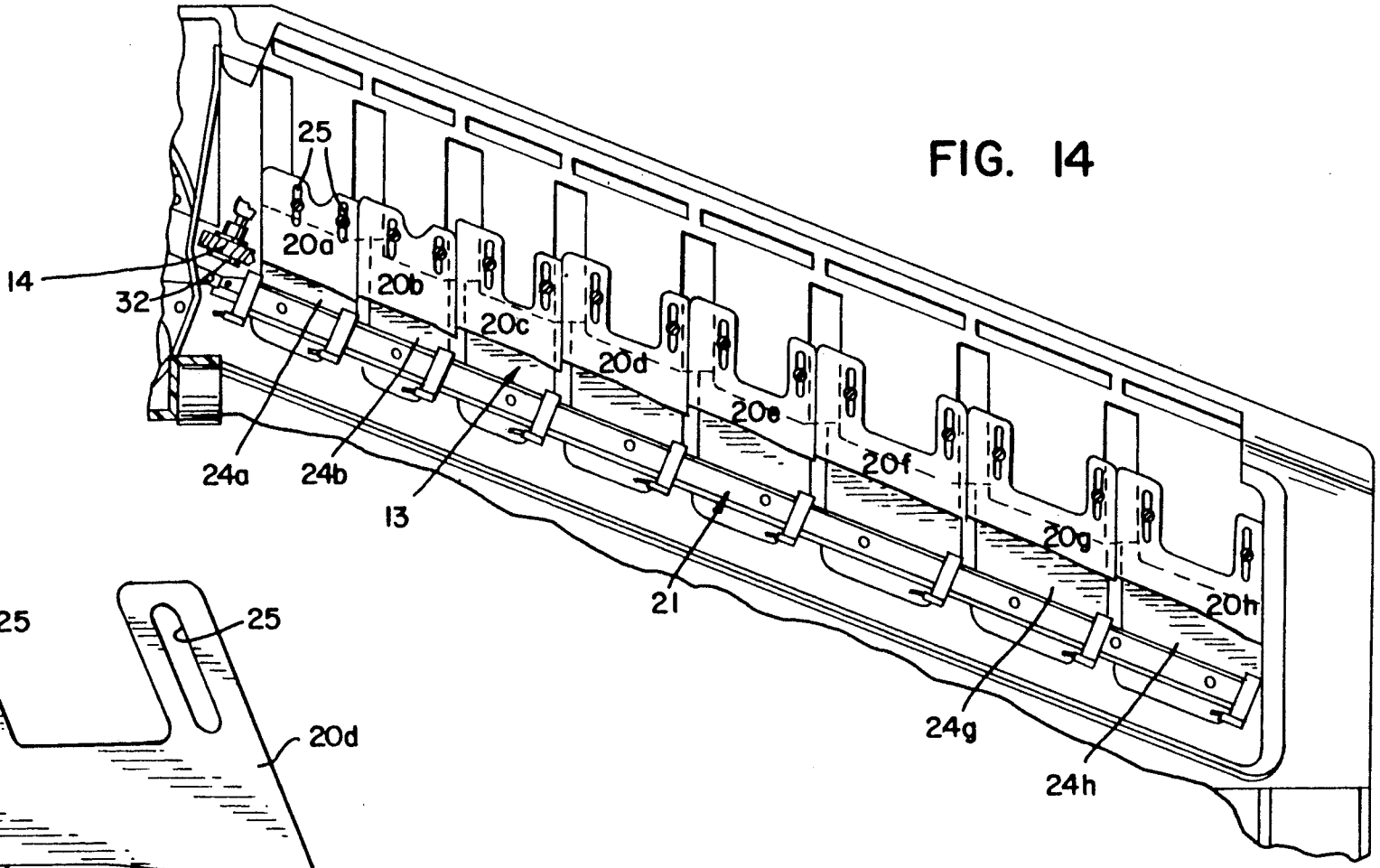
FIG. 14 is a view in elevation of the track structure showing the adjustable openings for the coins and with the belts removed for purposes of illustration.

As best seen in FIGS. 7 and 14, the track 13 includes a surface that is inclined rearwardly from the vertical and that is defined by a series of adjustable gates 20*a* through 20*h*. The track 13 is further defined by a bottom rail, indicated generally by the numeral 21, which is formed of a inclined bar 22 and a plate 23 defining an upstanding lip on the rail 21. The rail 21 is inclined relative to the horizontal. The housing 10 has a series of seperate openings 24*a* through 24*h* that are partially closed by the rail 21 at the bottom and by the adjustable gates 20*a*–*h* at the top. The rail 21 provides a reference edge for coins traveling along the track 13 and the gates 20*a*–*h* are adjustable relative to the rail 21 to be slightly larger than the diameter of a coin which is to be received in an opening at a particular gate. Each of the gates 20*a*–*h* includes parallel slots 25 which receive bolts 26 that fasten to the housing 10 to hold the gate in place.

The belts 14 and 15 are each formed with an inner surface of teeth 30 that engage with toothed sprocket wheels. At the overlap of the belts 14 and 15, a single toothed idler wheel 31 mounts both belts. An idler wheel 32 engages the front end of the first belt 14 and a drive sprocket 33 engages the rear end of the second belt 15. The idlers 31 and 32 and the drive sprocket 33 are mounted on projections of a carriage plate 34 that extends along the entire length of the track 13. The driven sprocket 33 is driven by a flexible circular belt 34 which passes over pulleys 35 and 36, with the pulley 36 being driven by a motor 37 (see FIG. 9). The rear of the runs of the coin belts 14 and 15 that are closest to the track 13 are supported by similar stationary and inflexible belt guides 38 and 39, respectively, which include top and bottom flanges 40 to hold the belts transversely in place as the belts move 14 and 15 along the track (see FIG. 7). The belt guides 38 and 39 are mounted by screws to the ends of projections 41 extending from the carriage 34 toward the rail 21, as shown in FIG. 7. Although toothed belts are used in the preferred embodiment, belts having a smooth inner surface driven by a friction drive are also usable.

Figure 4:
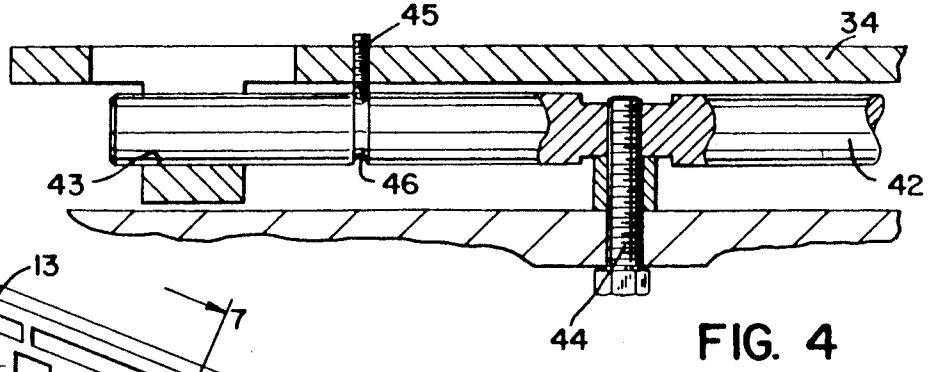
FIG. 4 is a view in section taken in the plane of the line 4—4 of FIG. 2 and illustrating the mounting of the carriage for the powered belts.

As shown in FIG. 4, the carriage 34 for the belt assemblies is journaled on a longitudinal rod 42 at bearings 43. The rod 42 is attached to the housing 10 by bolts 44. the carriage 34 is axially restrained on the rod 42 by set screws 45 engaging circumferential recesses 46 in the rod 42. The set screws 45 also take up the clearance between the rod 42 and the bearings 43. This mounting of the carriage 34 allows the carriage to be rotated to pivot the carriage 34 up and away from the track 13 in case access must be had to the track. The carriage 34 with the belt assemblies is normally held in its operative position by a wing nut 47 engaging a bolt 48 that passes through a slot in a bracket 49 journaled on one of the projections 41 of the carriage 34, as shown in FIGS. 2 and 7.

Each of the openings 24*a*–*h* formed in the housing 10 leads to a respective chute 50*a*–*h* formed in the housing and which empties into one of the drawers 16*a*–*h*. Coins of a size that do not fall through one of the openings 24*a*–*h* will fall off the end of the track 13 and into the final drawer 16*i*.

Arrayed along the length of the track 13 are a series of coin sensors 51*a*–*i*. The sensors 51 are positioned just prior to each of the openings 24*a*–*h* and just prior to the end of the track 13 in the case of the sensor 51*i*. The sensors 51 count each coin that passes their respective position along the track and by a system of subtraction determine the count of each denomination that passes through a respective opening, in a known manner. As an alternative, sensors could be disposed in each opening or on the chute side of each opening to count coins that pass through a particular opening.

The coin feeding mechanism 12 is of generally known construction and includes a rotating disc 55 that is inclined slightly rearwardly to the plane of the surface of the track 13. The disc 55 contains a series of flights 56 spaced about its periphery. As the disc 55 rotates through coins deposited in the hopper 11, it will pick up coins on its flights 56 and carry them past a sector plate 57 at the top of the loading mechanism. Coins at the top are free to fall from the flights once they pass beyond the sector plate 57. The coins will slide down the face of a stripper plate 58 and engage an inclined stripper bar 59. The face of the stripper plate 58 is in a plane that is parallel to the plane of the track surface. Only one of the larger sized coins can fit between successive flights 56, however multiple numbers of the smallest diameter can fit between the flights. Coins discharged from the flights 56 and falling over the stripper plate 58 will engage a transfer rail 59. Coins that do not fall from a flight will be carried behind the stripper plate 58 and back to the hopper 11. The transfer rail 59 has a section 60 of reduced thickness such that only one layer of coin can be supported on edge on the reduced thickness 60 (see FIG. 5). If two layers of coins encounter the reduced thickness section 60 of the transfer rail 59, the outermost coin will fall off the transfer rail (as shown in phantom lines) and be deposited back in the hopper where it can again be lifted up by the rotating disc 55. In this manner a single file of a single layer of coins are deposited on the transfer rail 59 and moved by gravity to the entrance to the track 13.

Figure 10:
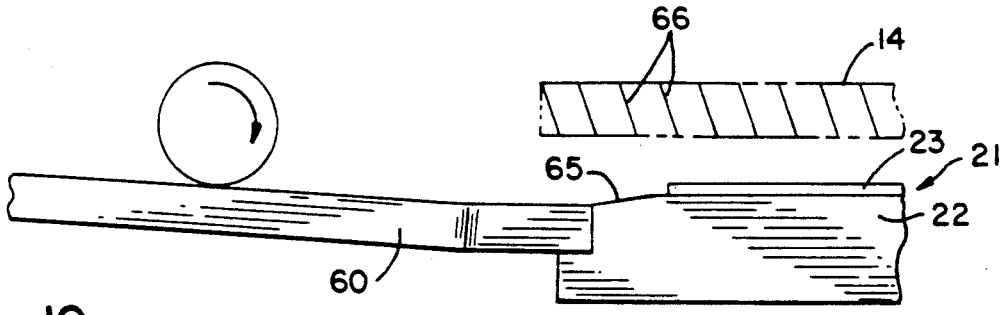
FIGS. 10, 11 and 12 are simplified illustrations of the transition from the coin loading mechanism to the track and illustrating the passage of a coin onto the rail of the track.
Figure 11:
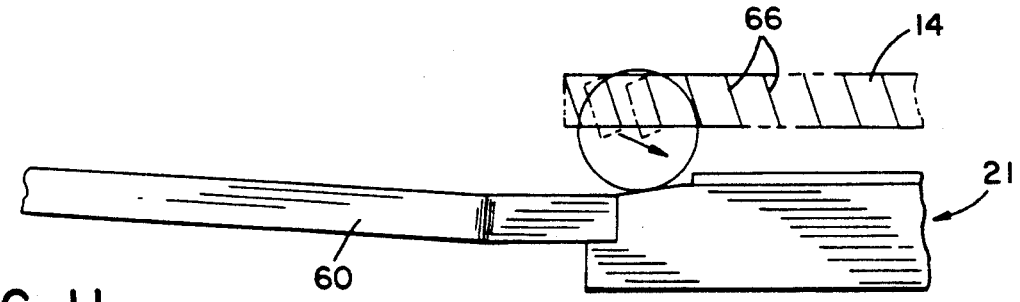
Figure 12:
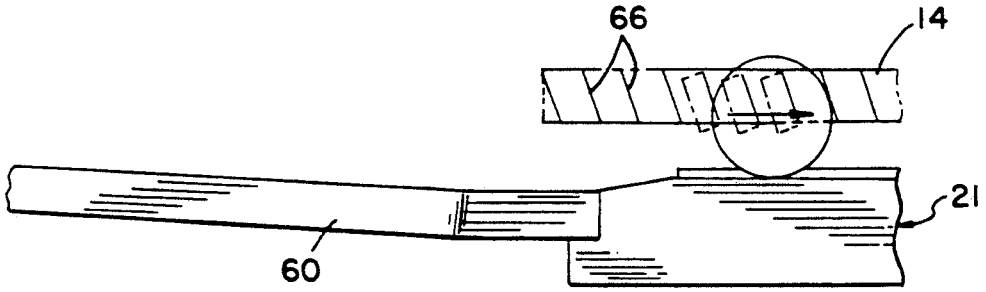
Figure 13:
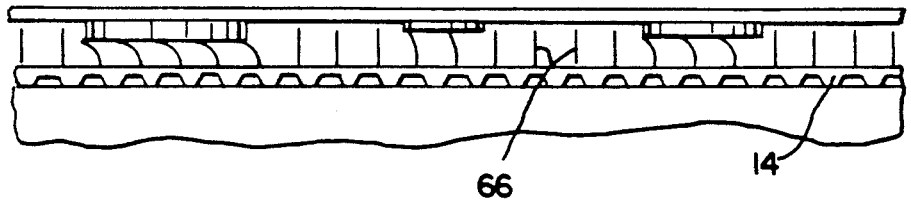
FIG. 13 is a simplified plan view of the distortion of the belt of FIGS. 1 through 12 as the belt moves the coins along the rail.

At the entrance to the track 13, the transfer rail extends into a ramp portion 65 of the bar 22 of the sorting rail 21. The coins must move up the ramp 65 to get to the elevation of the rail 21. At the same time that the coin engages the ramp 65 of the sorting rail, the coin is engaged by the first belt 14 as shown in FIGS. 10 through 12.

The outer or working face of the belts 14 and 15 each contain a plurality of spaced projecting fingers 66 which extend at an angle relative to the length of the belt. In the direction of travel of the belt, the lower edge of each finger 66 leads the upper edge of the finger, as shown in FIGS. 10 through 12 in which the operating run of the belt is shown in phantom lines. The ends of the fingers 66 are spaced sufficiently close to the surface of the track 13 to require the fingers to be distorted to accept even the thinnest coin between the belt and the track surfaces. As the belt first engages the coin at the ramp 65, the coin will distort the fingers 66 in order to fit between the fingers 66 and the surface of the track 13. The belts 14 and 15 and their fingers 66 are formed of a resilient material such as a natural or synthetic elastomer so that the fingers are flexible enough to accept the distortion. The distortion of the fingers by the coins is shown in FIGS. 10–13 and 17. The act of distorting the fingers 66 will result in the coins being forced down against the ramp 65 and against the bar 22 which defines the bottom of the rail 21. The distorting of the fingers also acts to retard the coins slightly which contributes to a proper spacing of successive coins along the track. Thereafter, the distorted fingers 66 if released will attempt to resume their normal position which will tend to lift the coins away from the rail 21. This tendency is overcome by positioning the belts 14 and 15 such that their longitudinal axes converge towards the rail 21 at the end of the rail and by making the spacing between the belts 14 and 15 and the surfaces of the gates 20 narrower at the end of the track then at the beginning. Both of these conditions contribute to retaining the coins on the rail 21 and therefore against the reference edge once they have been positioned against the rail. The tendency of the distorted fingers 66 to lift the coin is employed to assist in moving the coins over the lip 23 when they encounter the opening for their size.

Once the coins are gripped between the distorted fingers 66 and the surfaces of the gates 20, the coins will be slid down the track 13 by the belts 14 and 15 rather than being rotated. Therefore, non-circular coins or coins with nicks or dents in their periphery will not bounce on the track but will be kept against the rail 21 and will be properly sorted.

Figure 15:
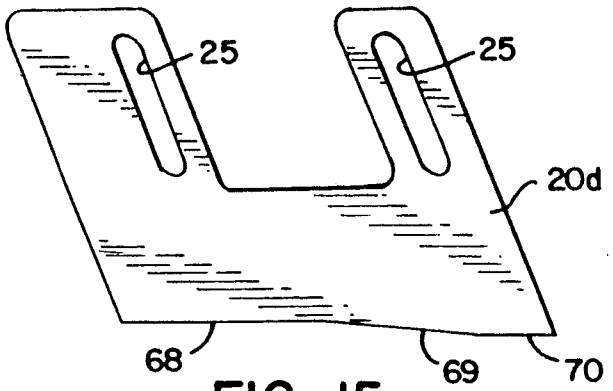
FIG. 15 is an enlarged elevation view of one of the gates that define the adjustable openings along the track.

As shown in FIG. 15, the lower operating edge of each of the gates exemplified by the gate 20*d* has a profile which differs from a straight line. The bottom edge first includes a straight line segment 68 which, when the gate 20*d* is installed, will be parallel to the rail 21. The segment 68 is followed by an inclined segment 69 which leads to a second straight segment 70 that will also be parallel with the rail 21 but nearer thereto. The result is that there is less tendency for a coin to catch at the end of an opening and at the transition to the following opening.

The working surfaces of the belts can take a variety of forms. Instead of inclined fingers that extend normal to the base of the belt as in the embodiments described above, fingers 70 which extend at an angle across the belt can also be inclined relative to the base 71 of the belt. The double inclined fingers 70 may be such that they extend rearwardly of or forwardly into the direction of travel of the belt, as shown in FIG. 17 and 18. Fingers 72 may also be curved away from a plane normal to the base of the belt as shown in FIG. 19.

The fingers need not be continuous along the width of belt. Instead, they could be made up of interrupted segments such as shown in FIG. 20 or can extend in two rows along the length of the belt as shown in FIG. 21.

The projections on the surface of the belt need not take the form of fingers. Instead, they can take the form of separate segments along an extended length of belt. Such alternative arrangements are shown in the embodiments of FIGS. 22 through 26 In FIGS. 22 and 23, a belt form is shown in which segments 75 are spaced slightly apart and rise from a common base 76. As shown in the cross-section of FIG. 23, each segment 75 includes a major portion defining a working section 77 that extends from one edge of the base 76 towards the opposite edge of the base 76. Such working section 77 is joined to the opposite edge of the base 76 by a fold 78. As shown in FIG. 24, when a free coin $C_1$ is moved between the surfaces of the track as defined by the adjustable gates and the working surface of the belt, the coin $C_2$ will be required to move downwardly in order to distort the segments 77. While distorted, the belt will exert an outward and slightly upward force on the coin which will propel it over the lip 23 of the rail 21 when it reaches its appropriate opening. The distortion of the segments 77 in a particular direction may be enhanced by the use of a fold or similar discontinuity, or simply by a section of reduced cross-section that will tend to buckle. FIGS. 25 and 26 illustrate additional belt cross-sections in which the portion that extends from one edge of the belt is free of the other edge of the belt instead of being connected thereto.

Common denominators for all of the belt designs are: that there is sufficient flexibility by reason of the form of the projections and the belt material that the coins can be griped between the belt and the track without the need of spring idler wheels or the like; that the initial distortion of the projections of the belt moves the coins against the reference edge defined by the rail; and that the distorted projections assist in moving the coins through their respective openings for sorting.

A coin sorter using the concepts of the present invention provides a fast and accurate sorting of coins. The sorter is capable of accurate sorting of coins with irregular peripheries and with coins whose diameters vary only slightly.

We claim:

1. A coin sorter, comprising:

a track having a reference edge defined by a rail with a lip;

a plurality of openings in the track and extending away from the reference edge, each opening sized to receive a coin of a particular diameter;

a coin feeder mechanism adapted to receive coins of mixed denominations and to provide a single file of a single layer of such coins to an entrance to the track; and a powered endless belt extending along the track and spaced therefrom to accept coins in the single file between the belt and the track, said belt having a coin engaging surface defined by a plurality of flexible projections that are oriented upon the belt such that when the projections are distorted by a coin the projections force the coin against the reference edge while the belt moves the coin along the track and the distorted projections impart a component of force to the coins that urges the coins away from the reference edge and past the lip and through a respective opening.

2. A coin sorter in accordance with claim 1 wherein the projections on the belt are spaced fingers extending across the width of the belt and at an angle relative to the length of the belt such that in the direction of belt travel, the lower edge of each finger leads the upper edge of the finger.

3. A coin sorter in accordance with claim 2 wherein the fingers are inclined from a plane normal to the base of the belt.

4. A coin sorter in accordance with claim 3 wherein the fingers are curved from a plane normal to the base of the belt.

5. A coin sorter in accordance with claim 3 in which each finger is defined by a plurality of segments arrayed across the width of the belt.

6. A coin sorter in accordance with claim 1 wherein the projections on the belt comprise a series of longitudinally spaced segments each rising from a common base and extending over the belt from one edge of the base.

7. A coin sorter in accordance with claim 6 wherein the segments are free of the edge of the base of the belt that is opposite to said one edge.

8. A coin sorter in accordance with claim 6 wherein the segments are connected to the edge of the base of the belt that is opposite to said one edge, by portions of the segments forming discontinuities in the cross sections of the segments.

9. A coin sorter in accordance with claim 1 wherein the coin engaging surface of the belt is closer to the track at the end of the track than at the entrance and the belt is disposed along an axis that converges toward the reference edge at the end of the track.

10. A coin sorter, comprising:

a track having a surface disposed in a plane inclined from the vertical and having a rail defining a reference edge that extends along a line inclined from the horizontal, said rail including a lip extending upwardly from the reference edge;

said track including a plurality of openings in the surface and extending upwardly from the rail, each opening being sized to receive a coin of a particular diameter;

a chute leading from each opening to a collection point for each size of coin;

a coin feeding mechanism adapted to receive coins of mixed denominations and to provide a single file of a single layer of such coins to an entrance to the track; and a powered endless belt extending along the track and spaced therefrom to accept coins in the single file between the belt and the track, said belt having a coin engaging surface spaced from the track a distance that is less than the thickness of the thinnest coin to be sorted, said coin engaging surface being defined by a plurality of flexible projections that are oriented upon the belt such that when the projections are distorted by the coins the projections force the coins against the reference edge while the belt slides the coins along the track and the distorted projections impart a component of force to the coins that urges the coins away from the reference edge and over the lip and through a respective opening.

11. A coin sorter in accordance with claim 10 wherein the coin feeding mechanism includes an inclined rotating disc having spaced flights that elevate coins to the top of the disc, together with an inclined transfer rail extending along the face of the disc and toward the entrance to the track, the end of the transfer rail being at an elevation below that of the entrance of the track rail, and the track rail having a ramp portion extending upwardly from the end of the transfer rail.

12. A coin sorter in accordance with claim 10 wherein the endless belt is disposed along an axis that converges toward the rail at the end of the rail and the coin engaging surface of the belt is closer to the surface of the track at the end of the track than at the entrance of the track.

* * * * *